US005799627A

United States Patent [19]

Dohn et al.

[11] Patent Number: 5,799,627

[45] Date of Patent: Sep. 1, 1998

[54] LIQUID COOLED CYLINDER HEAD FOR A MULTICYLINDER INTERNAL COMBUSTION ENGINE

[75] Inventors: Michael Dohn, Sersheim; Erhard Rau, Weilheim, both of Germany

[73] Assignee: Mercedes Benz AG, Stuttgart, Germany

[21] Appl. No.: 744,011

[22] Filed: Nov. 5, 1996

[30] Foreign Application Priority Data

Nov. 15, 1995 [DE] Germany ..... 195 42 494.8

[51] Int. Cl.[6] ..... F02F 1/36

[52] U.S. Cl. ..... 123/41.82 R

[58] Field of Search ..... 123/41.82 R

[56] References Cited

U.S. PATENT DOCUMENTS

| | | | |
|---|---|---|---|
| 2,205,646 | 6/1940 | Fahlman | 123/41.82 R |
| 4,567,859 | 2/1986 | Taguchi et al. | 123/41.82 R |
| 4,641,609 | 2/1987 | Tanaka | 123/41.82 R |
| 4,690,104 | 9/1987 | Yasukawa | 123/41.82 R |
| 4,889,079 | 12/1989 | Takedo et al. | 123/41.82 R |

FOREIGN PATENT DOCUMENTS

| | | |
|---|---|---|
| 24 52 999 | 5/1979 | Germany . |
| 38 19 655 | 1/1989 | Germany . |
| 41 16 943 | 6/1992 | Germany . |
| 56-148647 | 11/1981 | Japan . |

*Primary Examiner*—Noah P. Kamen
*Attorney, Agent, or Firm*—Klaus J. Bach

[57] ABSTRACT

In a liquid cooled cylinder head for a multi-cylinder internal combustion engine including in the cylinder head a cooling water space which is divided into cooling water space sections each disposed above one of the combustion chambers formed in the cylinder head bottom, a trapezoid-shaped cooling water flow control rib element projects from the cylinder head top above each combustion chamber in a plane extending essentially normal to the flow direction of the cooling water in the cylinder head such that the cooling water is deflected onto the cylinder head bottom above the respective combustion chambers.

5 Claims, 2 Drawing Sheets

LIQUID COOLED CYLINDER HEAD FOR A MULTICYLINDER INTERNAL COMBUSTION ENGINE

BACKGROUND OF THE INVENTION

The present invention resides in a liquid-cooled cylinder head of an internal combustion engine including a cooling water space which is disposed between the cylinder head bottom and a cylinder head top and which comprises for each combustion chamber a particular cooling water space section and a cooling water flow guide element extending into the cooling water space.

DE 38 19 655 C1 discloses a cylinder head consisting of a single piece casting. The cylinder head includes a cooling water space formed between the outside walls and the cylinder head bottom and the cylinder head top. It further includes gas inlet and outlet passages and recesses for the reception of fuel injectors which extend through the cooling water space. Also cooling water passages direct coolant from the crankcase or engine block to the cooling water space in the cylinder head. Arranged in the cooling water space between the cylinder head bottom and top, are reinforcement webs which serve at the same time as guide elements for the cooling water. They direct the cooling water onto components especially in need of cooling.

It is a disadvantage of the arrangement described above that the guide elements provide only limited guidance for directing the cooling water toward the cylinder head bottom so that the cooling effect is insufficient at particularly in certain critical areas of the cylinder head bottom.

For further general background information, reference is made to DE 41 16 943 C1.

It is the object of the present invention to provide a cylinder head wherein all critical areas of the cylinder head bottom near the combustion chambers and the gas exhaust passages are sufficiently cooled during engine operation.

SUMMARY OF THE INVENTION

In a liquid cooled cylinder head for a multi-cylinder internal combustion engine includes in the cylinder head, a cooling water space which is divided into cooling water space sections disposed above the combustion chambers formed in the cylinder head bottom. A trapezoid-shaped cooling water flow control rib projects from the cylinder head top above each combustion chamber in a plane extending essentially normal to the flow direction of the cooling water in the cylinder head such that the cooling water is deflected onto the cylinder head bottom above the respective combustion chambers.

With the liquid cooled cylinder head according to the invention, the cooling of the cylinder head bottom area in the cooling water space sections adjacent the various combustion chambers is substantially improved. The ribs projecting from the cylinder head top form guide elements which extend across the flow path of the cooling water and direct the cooling water downwardly onto the cylinder head bottom. The cooling water impinges onto the cylinder head bottom between the inlet and outlet passages that is in the area of the highest combustion chamber temperatures. Because of the rib, the flow cross-section is further reduced so that, at this point, also the cooling water flow speed is increased which further increases the cooling effectiveness at the critical areas of the cylinder head bottom.

Preferably, a cooling water guide rib is provided for each of the cooling water space sections so that the temperature is essentially the same over the length of the cylinder head bottom whereby the temperature loading of the cylinder head is relatively low.

It is further preferred if the rib is arranged in the cooling water space so as to extend in the direction of the longitudinal center plane of the combustion chamber and is disposed in the middle above the center of the combustion chamber. Then the cooling water flow is specifically directed toward the central area of the cylinder head bottom adjacent the combustion chamber between the gas flow channels which is normally subjected to the highest temperature load.

The rib has a trapezoidal shape with the short edge being disposed at the free end of the rib, whereby the cylinder head can be easily manufactured. Because of the symmetrical shape of the rib in the form of a trapezoid, the casting core as needed for the casting of the cylinder head has a relatively simple shape and can therefore be easily and inexpensively manufactured. The core is particularly simple if the ribs are arranged at the same distances from each other in the direction of a longitudinal center plane of the cylinder head. The trapezoidal shape of the ribs also optimizes the flow resistance for the cooling water.

Preferably the ribs have a height of at least half the height of the cooling water space and a length of at least half the length of the cooling water space section in the direction of the longitudinal center axis of the cylinder head. The cooling water flow direction can be well controlled as the cooling water flowing through the cooling water space impinges on the surfaces of the ribs and is deflected toward the cylinder head bottom.

Further features of the invention will become apparent from the following description of an embodiment thereof which will be described below on the basis of the enclosed drawings.

DESCRIPTION OF A PREFERRED EMBODIMENT

Figure 1:
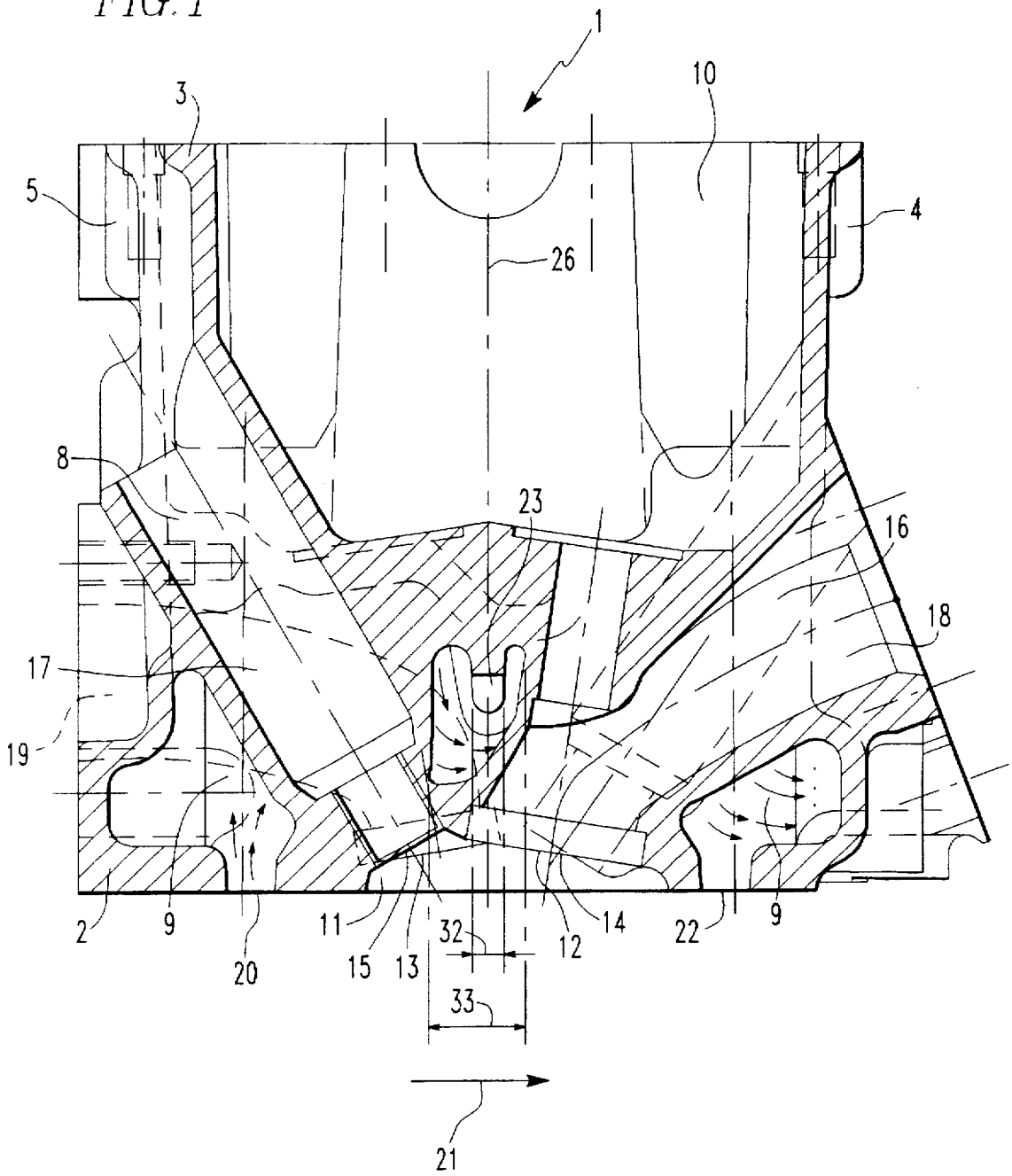
FIG. 1 is a cross-sectional view of the cylinder head according to the invention.

A cylinder head for a multicylinder internal combustion engine which is not shown specifically comprises a single piece casting including a cylinder head bottom 2, and longitudinal side walls 4 and 5 and front and rear side walls 6 and 7, all extending upwardly from the bottom to a head cover mounting plane 3. Together with the cylinder head bottom 2, the outer walls 4 to 7 enclose a space which is divided, by a cylinder head top 8 disposed at a distance from the cylinder head bottom, into a cooling water space 9 and a valve control space 10 extending up to the head cover mounting plane 3.

The cylinder head bottom 2 includes for each cylinder a bottom recess defining a combustion chamber 11 which has two flow passage openings 12, 13 per cylinder. It further includes two other openings 14, 15 leading from the combustion chamber 11 to recesses 16, 17 formed in the cylinder head from the top for the reception of spark plugs or injection nozzles for example. From the passage openings 12, 13, gas flow passages 18, 19 extend through the cooling water space 9 to the longitudinal outer side walls 4 and 5. The gas flow passage 18 extending from the flow passage opening 12 to the outer side wall 4 forms a gas inlet passage and the gas flow passage 19 extending from the flow passage opening 13 to the outer side wall 5 forms the gas outlet passage. The recesses 16 and 17 are arranged at an angle in the shape of a V and extend through the cooling water space 9 to the cylinder head top 8. Cooling water flows through the inlet openings 20, 22 in the cylinder head bottom into the cooling water space 9. The cooling water entering through the inlet opening 20 flows through the cooling water space 9 about in the direction of a transverse axis 21 of the cylinder head 1. Subsequently, the cooling water exits through an outlet opening formed in the side wall 4 of the cylinder head 1 on the same side of the gas inlet opening, but not shown in the drawings.

To improve the cooling of the central area of the cylinder head bottom sections adjacent the combustion chambers, a rib 23 extends from the cylinder head top 8 and projects toward the cylinder head bottom 2 essentially transverse to the flow direction of the coolant entering the cooling water space 9. The cooling water impinges onto the rib 23 and is deflected toward the cylinder head bottom 2 onto the highly temperature stressed area between the gas inlet passage 18 and gas outlet passage 19. As the cooling water impinges strongly onto the cylinder head bottom 2, it provides for excellent contact of the cooling water flow with the cylinder head bottom which provides for improved cooling effectiveness. Furthermore, the rib 23 narrows the flow cross-section which increases the cooling water flow speed in that area. Altogether, this provides for improved cooling of the various cylinder head areas particularly in the critical areas at the cylinder head bottom 2 between the passages in the cylinder head. The cooling water supply to the cooling water space 9 and the cooling water flow within that space are indicated in FIG. 1 by arrows.

Figure 2:
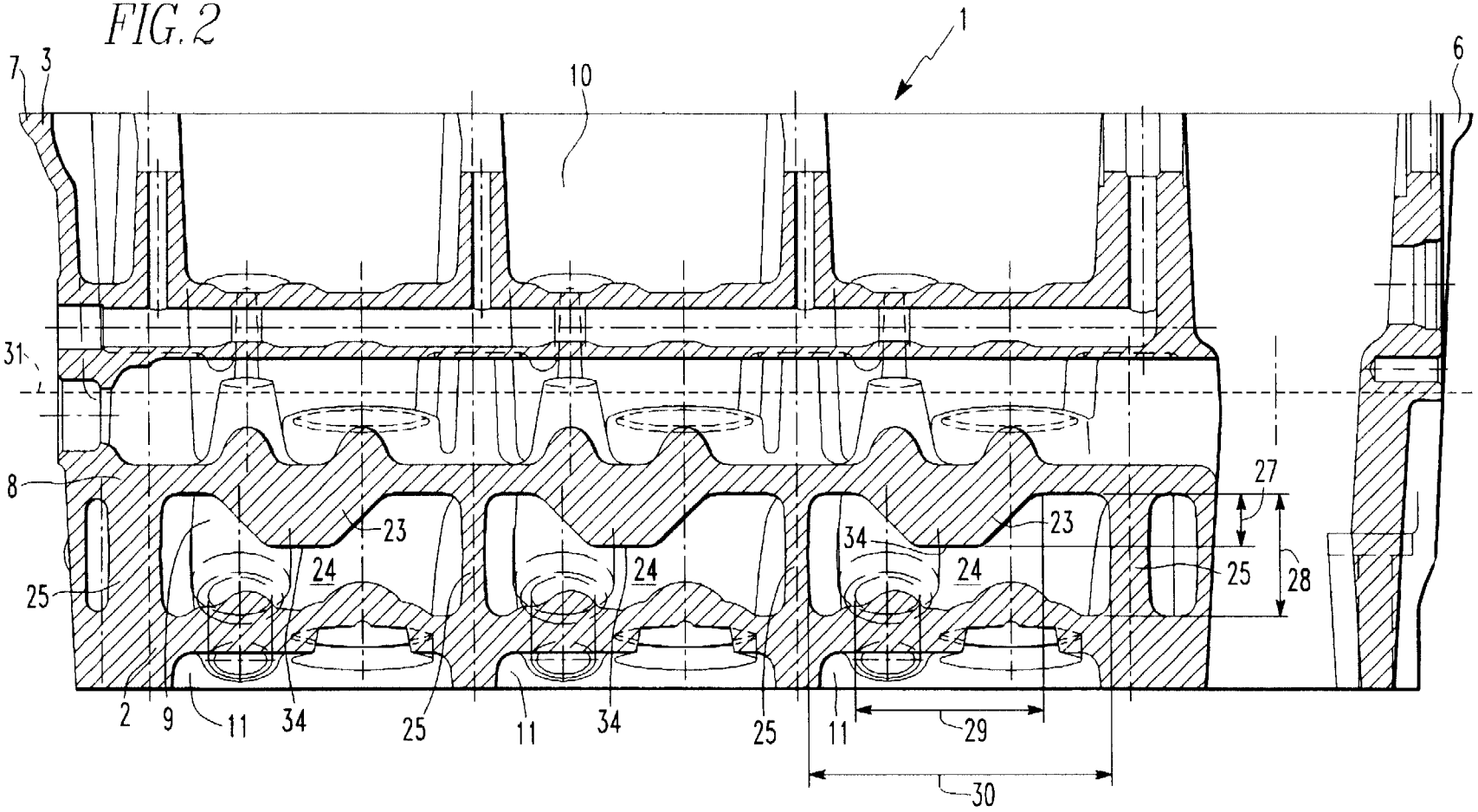
FIG. 2 shows the cylinder head of FIG. 1 in a longitudinal cross-section.

As shown in FIG. 2, the cooling water space 9 is divided into equal cooling water space sections 24, each arranged adjacent one of the combustion chambers 11. Between the various cooling water space sections 24 of the cylinder head 1, there are disposed Z-shaped reinforcement walls 25 which extend from the cylinder head bottom up to the cylinder head top 8. The cylinder head top 8 extends from the outer end walls 6, 7 over the whole width of the cylinder head 1. A rib 23 which projects downwardly into the cooling water space 9 is disposed in each cooling water space section 24. As can be seen in FIG. 1, the rib 23 extends in the longitudinal center plane 26 of the combustion chamber 11. It has a trapezoidal shape and is located essentially centrally over the combustion chambers 11 is shown in FIG. 2.

The height 27 of the rib is at least half the height 28 of the cooling water space 9, the length 29 of the rib 23 is at least half the length 30 of the cooling water space section in the direction of the longitudinal center axis 31 and the width 32 of the rib 23 is at least half the length 33 of the cooling water section 24 in the transverse direction 21. The trapezoidal shaped rib 23 extends into the cooling water space 9 in a cantilevered fashion with its short edge 34 being disposed farthest in the cooling water space 9 whereby part of the cooling water flow is deflected onto the cylinder head bottom 2. In this manner, improved cooling is obtained for selected parts of the cylinder head bottom without substantial increase in the flow resistance.

What is claimed is:

1. A liquid cooled cylinder head for a multicylinder internal combustion engine having a longitudinal center plane and including a cylinder head bottom, a cylinder head top spaced from the cylinder head bottom and spaced front and rear and longitudinal side walls defining therebetween a cooling water space divided into cooling water space sections, a combustion chamber formed in the cylinder head bottom adjacent each cooling water space section, and a trapezoid-shaped flow control rib projecting from said cylinder head top toward at least one of said combustion chambers and extending in the direction of said longitudinal center plane and essentially transverse to the flow direction of the cooling water such that the cooling water is deflected thereby onto the cylinder head bottom above the respective combustion chamber, said rib having a longer edge disposed at the cylinderhead top and a short edge at the projecting end of said rib adjacent a respective combustion chamber.

2. A cylinder head according to claim 1, wherein a rib is disposed in each cooling water space above each combustion chamber.

3. A cylinder head according to claim 1, wherein said rib is arranged in the center area of a longitudinal center plane portion above a respective combustion chamber.

4. A cylinder head according to claim 1, wherein said rib has a height which is at least half the height of said cooling water space.

5. A cylinder head according to claim 1, wherein said rib has a length which is at least half the length of the cooling water space section in the direction of the longitudinal center plane.

* * * * *